US007004676B2

(12) United States Patent
Williams

(10) Patent No.: US 7,004,676 B2
(45) Date of Patent: Feb. 28, 2006

(54) FLY MAX POWER TROWEL

(75) Inventor: Richard A. Williams, Lake Havasu City, AZ (US)

(73) Assignee: Progressive Power Equipment, LLC, Lake Havasu, AZ (US)

( * ) Notice: Subject to any disclaimer, the term of this patent is extended or adjusted under 35 U.S.C. 154(b) by 0 days.

(21) Appl. No.: 10/151,677

(22) Filed: May 20, 2002

(65) Prior Publication Data

US 2003/0215289 A1 Nov. 20, 2003

(51) Int. Cl.
*E01C 19/42* (2006.01)
*E01C 23/07* (2006.01)

(52) U.S. Cl. ..... 404/112; 404/118; 404/84.1; 404/84.5

(58) Field of Classification Search ..... 404/112, 404/118, 84.05, 84.5
See application file for complete search history.

(56) References Cited

U.S. PATENT DOCUMENTS

| | | | | |
|---|---|---|---|---|
| 4,740,348 A | | 4/1988 | Rose | |
| 4,784,519 A | * | 11/1988 | Artzberger | 404/112 |
| 4,848,960 A | * | 7/1989 | Kajioka et al. | 404/112 |
| 5,108,220 A | * | 4/1992 | Allen et al. | 404/112 |
| 5,372,452 A | * | 12/1994 | Hodgson | 404/112 |
| 5,405,216 A | * | 4/1995 | Allen et al. | 404/112 |
| 5,816,740 A | * | 10/1998 | Jaszkowiak | 404/112 |
| 6,019,545 A | * | 2/2000 | Allen et al. | 404/112 |
| 6,106,193 A | * | 8/2000 | Allen et al. | 404/112 |

* cited by examiner

*Primary Examiner*—Raymond Addie
(74) *Attorney, Agent, or Firm*—Jeffrey D. Moy; Harry M. Weiss; Weiss, Moy & Harris, P.C.

(57) ABSTRACT

A light weight motorized concrete finishing machine with a set of blades that rotate on a single plane, held by a hub assembly that resists deflection, specially equipped with quick release system for trowel blades. Blade pitch is controlled by an actuator that can be adjusted manually or remote powered. The unit is equipped with a remote means of hands free operation of blade pitch and throttle control. Right to left directional motion of machine is controlled by an articulated steering mechanism.

4 Claims, 5 Drawing Sheets

FLY MAX POWER TROWEL

BACKGROUND OF INVENTION

The present invention relates to a motorized concrete finishing power trowel with remote control capabilities of blade pitch and throttle control.

There are various types of power trowels in the market place, one type being a conventional walk behind and another other type a light weight pole operated power trowel. One such machine is described in U.S. Pat. No. 4,740,348. This machine is controlled by a pole that is afixed to the machine. The machine is enabled to go left or right by raising or lowering the pole. The engine throttle is also controlled by a clockwise or counter-clockwise rotation of the poles, which makes the machine difficult to operate at a distance. The finishing blade that makes contact with the concrete is fixed in one position and will not adjust, which limits the finishing ability.

SUMMARY OF THE INVENTION

The present invention differs from the prior art by using a steering mechanism which allows a greater distance and easy one handed steering by rotating poles in a clockwise or counter-clockwise direction, either left or right. This steering design makes it possible to operate the machine at great distances. The present invention also has a rotating hub assembly which resists deflection and provides rigid finish blade mounts. The finish blade on the present invention has a quick release system that allows the blades to be replaced with minimal effort. A blade pitch actuator adjusts the pitch of the blade which is necessary to accommodate changing surface conditions of the concrete as it dries.

The blade pitch actuator and engine throttle are remote controlled making it possible for RPM and blade adjustments while in operation.

THE DRAWINGS

A preferred embodiment of the invention is illustrated in the accompanying drawings in which.

DETAILED DESCRIPTION OF THE PREFERRED EMBODIMENTS

In order to better illustrate the advantages of the invention and its contributions to the art, a preferred hardware embodiment of the invention follows.

Figure 1:
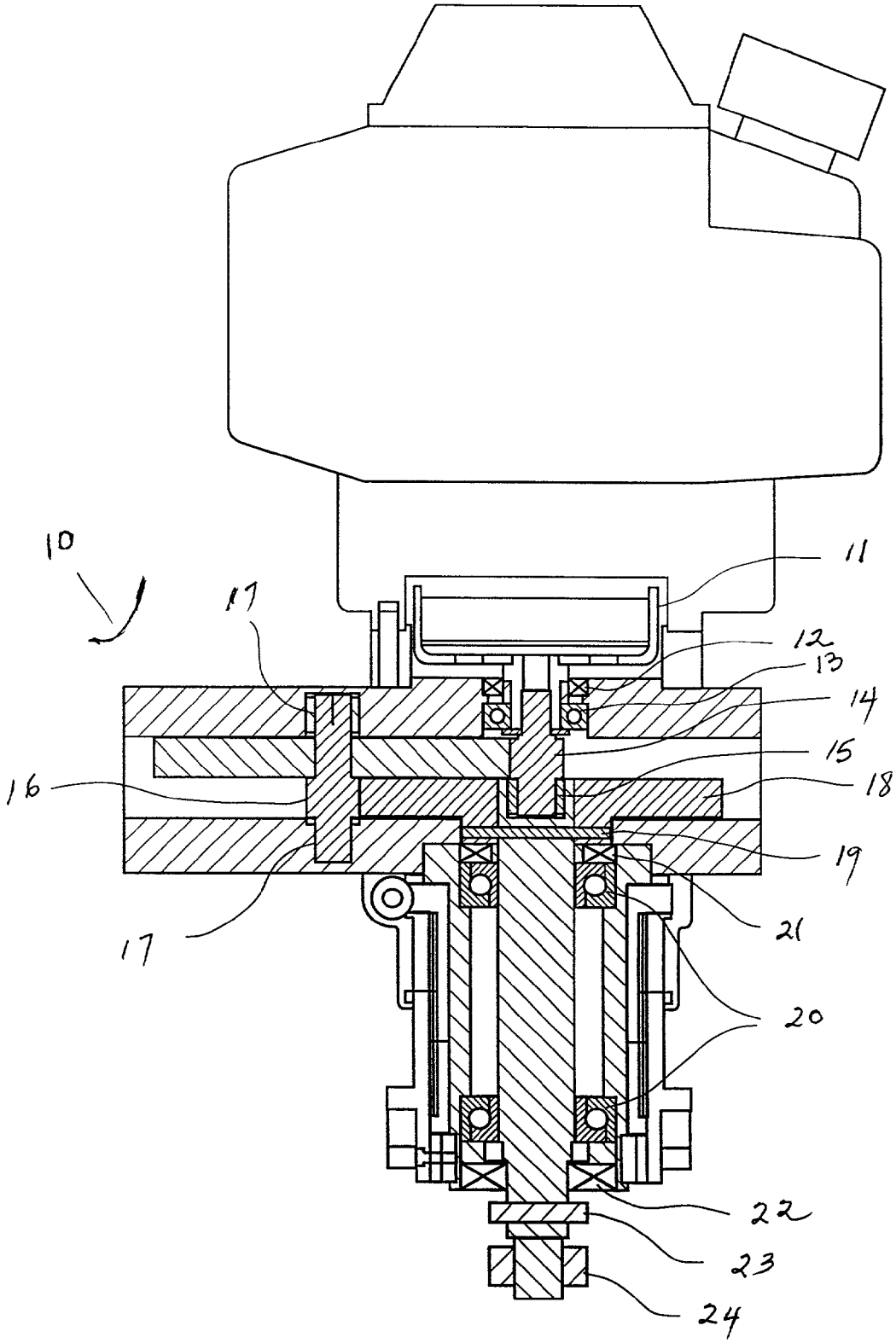
FIG. 1, is a side elevational view of the machine.

FIG. 1 (Drive Train), shows a commercially available internal combustion engine (10) which is coupled to the drive train via a centrifugal clutch (11). The centrifugal clutch is threaded into the vertically mounted motor gear (14), which encapsulates the spring seal (12) and ROLLER BALL BEARING® (13), the opposite motor gear (14) end is supported with needle bearings (15). The idler gear assembly (16) contains a large gear driven by the motor gear (14), and also contains a smaller gear that drives the main shaft gear (18). The idler gear assembly (16) is supported on either end by needle bearings (17). The main shaft gear (18) is pinned to a vertically mounted main shaft (19) that is supported between angular contact ball bearings (20) and sealed with an upper spring seal (21) and a lower spring seal (22).

Figure 2:
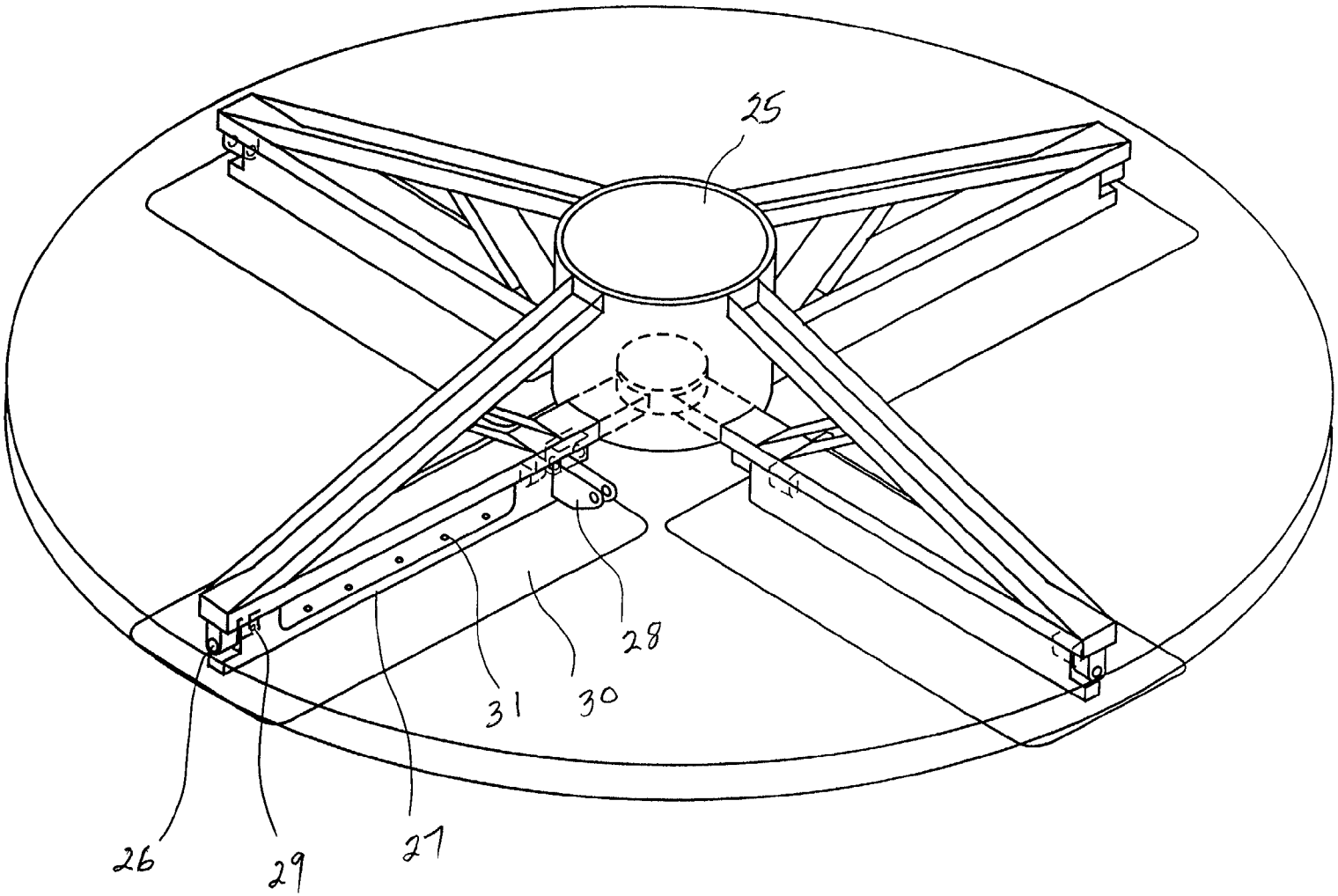
FIG. 2, is a perspective view of the rotary blade assembly.

FIG. 2 (Rotating Blade Assembly), represents a welded aluminum frame assembly (25) that is attached to the main shaft (19) with the drive pin (23) and the retaining nut (24) as shown in FIG. 1. The blade mount pins (26) provide a pivot point as well as mounting point for the blade mounts (27). Horizontally mounted trowel tilt levers (28) slide onto the inner mount pins (26) which engage the blade mounts (27) by means of a slot cut in the trowel tilt lever (28). The trowel tilt levers are retained by use of the blade mount cotter pin (29). At the bottom of this mechanism are the four finishing blades (30) which are connected by rivets (31).

Figure 3:
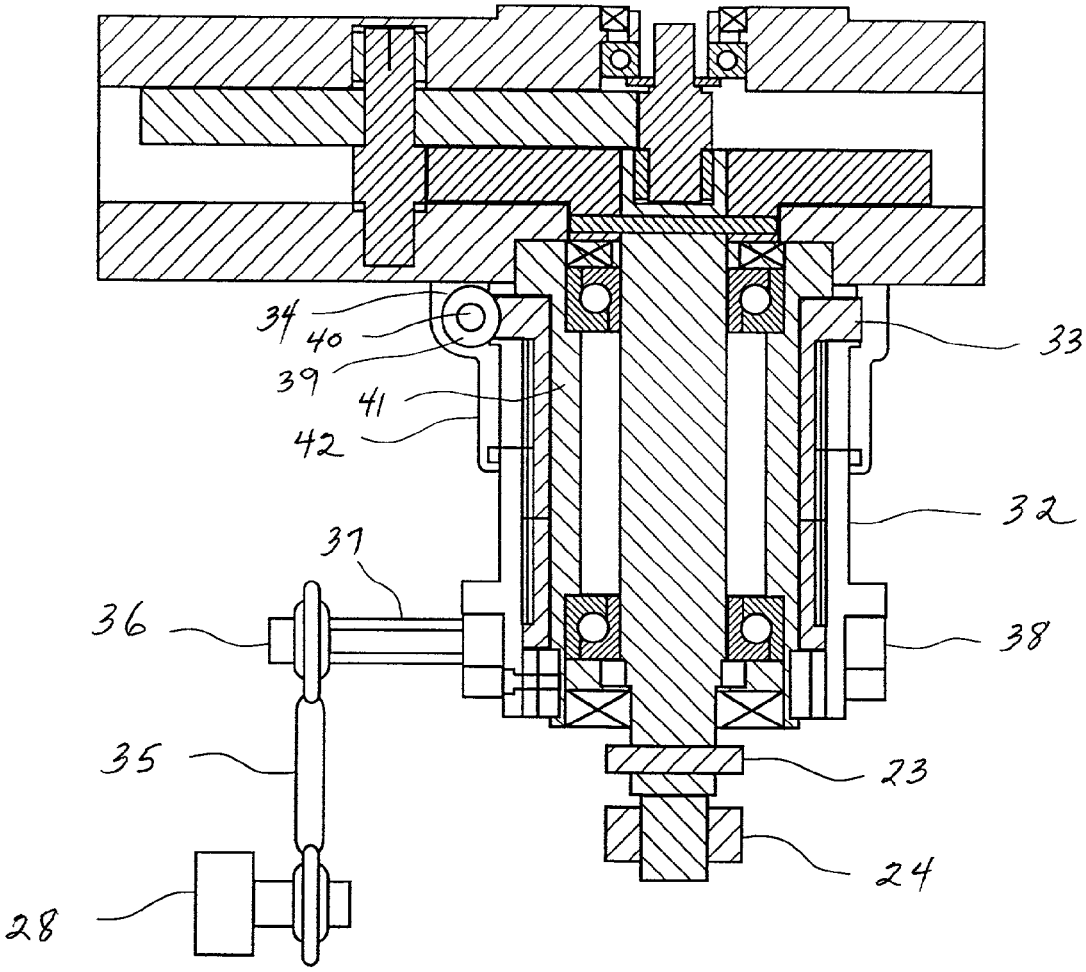
FIG. 3, is a side elevational view of the machine.

FIG. 3 (Linear Displacement Assembly), illustrates the outer acme drive (32) which has vertical linear motion provided by the mesh of the rotating threads on the acme drive (33). The vertical displacement of the outer acme drive (32) is transferred to the linkage assembly (35) via screw (36) and spacer (37) threaded into the rotating thrust ring (38). The rotating thrust ring (38) is rotated by the previously mentioned spacer (37) which engages through the slots in the welded aluminum frame (25). The acme drive (33) is rotated by means of the gear mesh from the worm gear (39) which is driven by the acme gear worm shaft (40) which is supported on either end by ball bearings (34) located inside of the worm housing (42). The acme drive (33) rotates about the bearing housing (41), while the bearing housing (41) guides, and retaining key restrains the outer acme drive (32) from turning.

Figure 4:
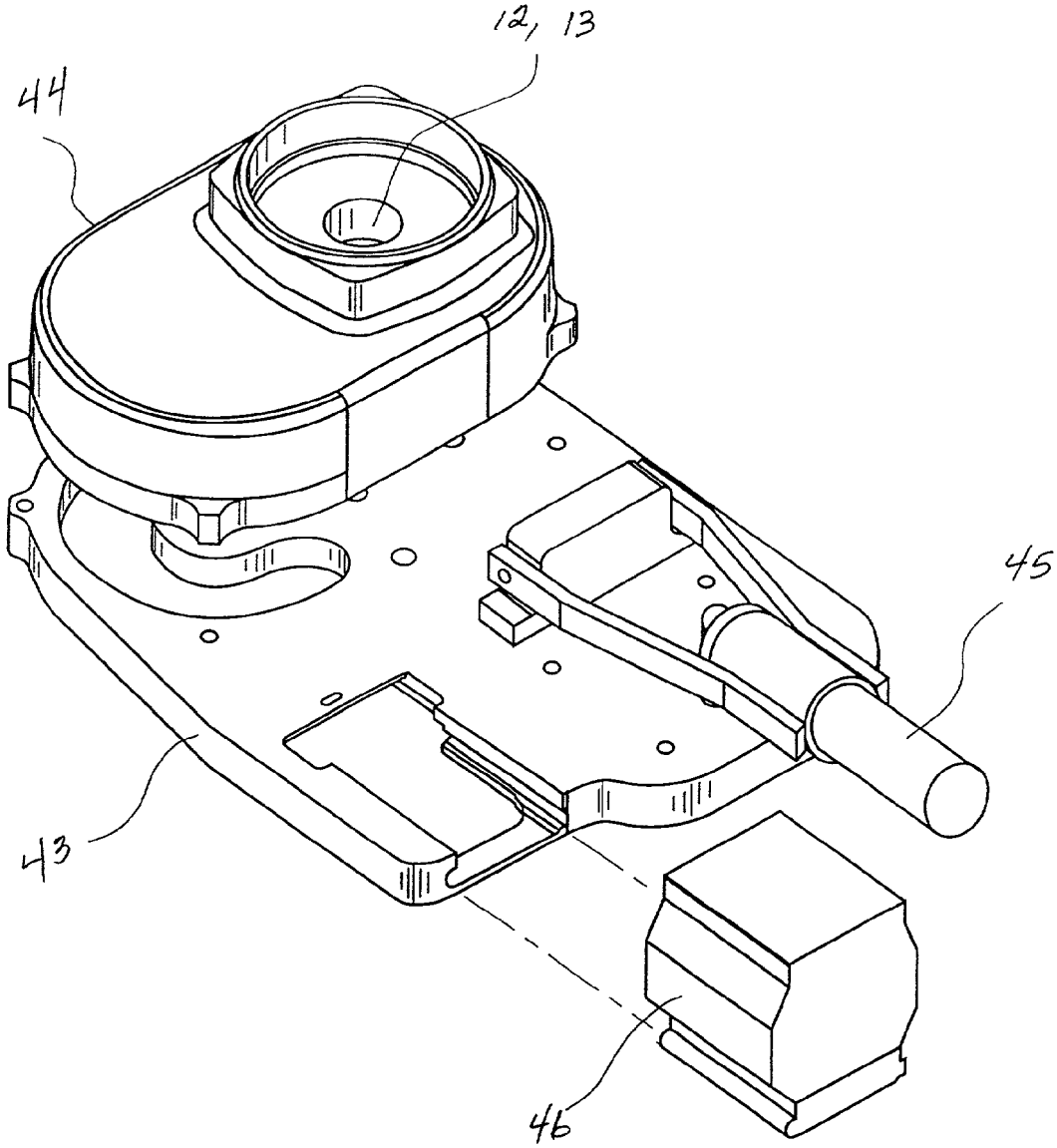
FIG. 4, is a perspective view of the machine.

FIG. 4 (Transmission Housings), demonstrates the base plate (43) which is a base frame that the above described assembles attach. The base plate (43) also retains the battery pack (46) and the articulated steering device (45). Top gear case (44) encloses the drive train and houses ball bearing (13) and spring seal (12).

The control system is made up of two main components, the "handheld" transmitter and the equipment mounted receiver.

Figure 5:
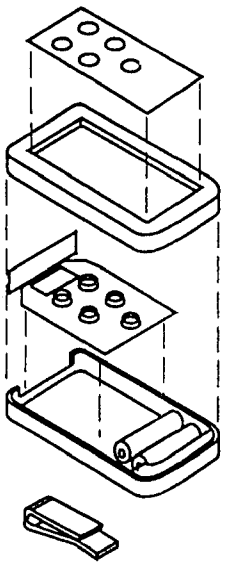
FIG. 5, is an exploded view of the remote control for the machine.

The transmitter, shown in FIG. 5 is a battery operated unit which encodes commands from the operator and sends them via radio frequency to the receiver. The operator inputs commands into the transmitter by depressing pushbuttons, which are interpreted by a microprocessor based circuit. The commands along with security information are encoded into a serial stream and radiated via radio signals to the receiver. Other suitable wireless communication media could also be used to send the encoded serial stream.

Figure 6:
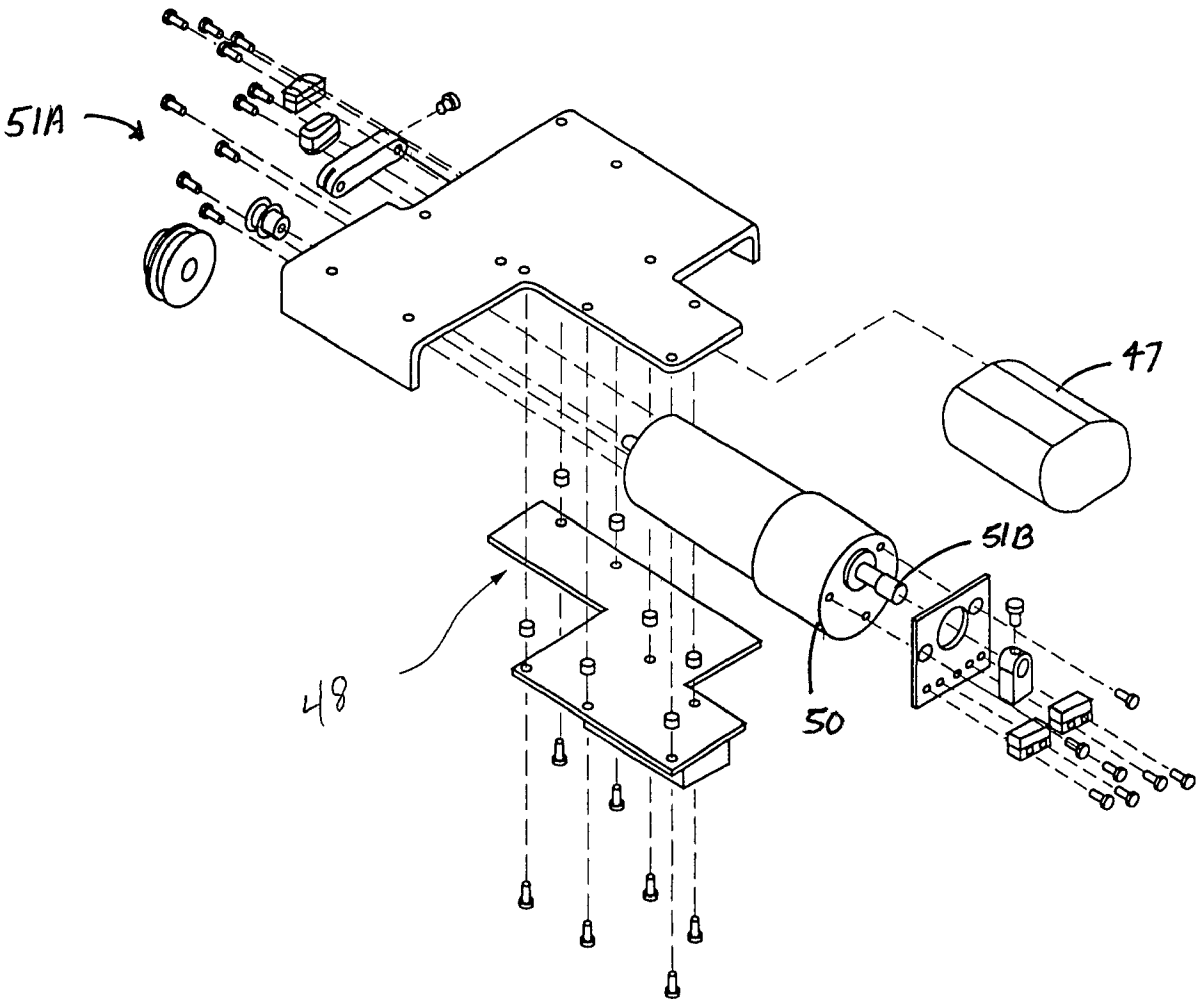
FIG. 6, is an exploded view of the control mechanism of the machine.

The receiver (48) shown in FIG. 6 receives signals from the transmitter and actuates the commanded motion. The serial stream from the transmitter is recovered by the microprocessor (47) based circuit in a receiver (48). The recovered serial stream is interpreted by the microprocessor and checked for correct formatting. The microprocessor also verifies that the address that is embedded into the serial stream matches the one stored in the receiver's memory. This address verification ensures that only one transmitter is able to control the receiver. Once the receiver has recovered a valid serial stream, outputs are activated based on the commands in the stream.

Throttle increase and decrease are two of the functions the receiver is required to control. The throttle of the engine (10) is controlled by a microprocessor (47), that is mechanically linked 51A to the carburetor of engine (10). Throttle increase commands that are received cause the throttle to control the engine (10) to be engaged in one direction while decrease commands move it in the other direction. If the throttle is either at full throttle or idle, any further movement in that direction is inhibited. Movement in a particular direction is limited by a combination of electro mechanical switches and mechanical linkages, but could be accomplished in a number of other ways.

Blade pitch increase and decrease are two other functions the receiver must control. The pitch of the blades is controlled by an electric motor 50 that is mechanically linked to pitch control assembly via a belt drive 51B. Pitch increase commands that are received cause the electric motor 50 to be engaged in one direction while decrease commands move it in the other direction. If the pitch control is either at maximum or minimum pitch, any further movement in that direction is inhibited. Movement in a particular direction is limited by a combination of electro mechanical switches and mechanical linkages, but could be accomplished in a number of other ways.

Engine stop is another function of the control system. By depressing and holding a single button on the transmitter (FIG. 5), the operator can shut down the engine of the power trowel. This provides for safe control of the equipment from a distance.

Several other safety features are built into the control system to allow for safe operation. The receiver (48) is able to automatically perform certain control functions when specific conditions occur. The throttle is returned to idle automatically when an engine stop command is issued from that transmitter or whenever the power switch on the receiver is moved from off to on. The receiver also automatically stops all functions whenever the operator removes his hand from the transmitter.

While this invention has been described and illustrated herein with respect to preferred embodiments, it is understood that alternative embodiments and substantial equivalents are included within the scope of the invention as defined by the appended claims.

I claim:

1. Apparatus for smoothing the surface of freshly poured concrete, including:

a) a structural frame;

b) drive means centrally attached to said structural frame for providing rotational motion to said structural frame for providing rotational motion to said structural frame;

c) elongate steering means attached to said structural frame for controlling the direction of movement of said structural frame;

d) a plurality of longitudinally extending blades removably coupled to said structural frame, each of said blades extend from a central pivot outwardly a predetermined distance, said plurality of blades being rotatably connected at one end thereof to said drive means, and being adapted for variation in pitch of said blades during operation;

e) speed control means for controlling the speed of rotation of said drive means;

f) pitch control means for controlling the pitch of said longitudinal blades wherein said pitch control means comprises:

1) a pitch control motor for adjusting the pitch of said plurality of longitudinally extending blades; and 2) a belt for coupling said pitch control motor to said plurality of longitudinally extending blades to allow the pitch control motor to adjust the pitch of the longitudinally extending blades; and g) remote operational control means for operating both the speed of said central drive means and for controlling the pitch of said longitudinal blades.

2. Apparatus as set forth in claim 1, wherein said structural frame is circular in lateral dimension.

3. Apparatus as set forth in claim 1, wherein said drive means is a motor.

4. Apparatus as set forth in claim 1, wherein said steering means controls solely the lateral or longitudinal movement of said frame.

* * * * *